US011232704B1

(12) United States Patent
Gardner

(10) Patent No.: US 11,232,704 B1
(45) Date of Patent: Jan. 25, 2022

(54) SMOKING DETECTION DEVICE WITH TAMPER COUNTERMEASURES

(71) Applicant: Donesha Baldwin Gardner, Atlanta, GA (US)

(72) Inventor: Donesha Baldwin Gardner, Atlanta, GA (US)

(73) Assignee: Donesha Baldwin Gardner, Atlanta, GA (US)

( * ) Notice: Subject to any disclaimer, the term of this patent is extended or adjusted under 35 U.S.C. 154(b) by 0 days.

(21) Appl. No.: 17/247,925

(22) Filed: Dec. 30, 2020

(51) Int. Cl.
*G08B 29/04* (2006.01)
*G08B 5/36* (2006.01)
*G08B 17/103* (2006.01)

(52) U.S. Cl.
CPC ..... *G08B 29/046* (2013.01); *G08B 5/36* (2013.01); *G08B 17/103* (2013.01)

(58) Field of Classification Search
CPC ..... G08B 29/046; G08B 17/103; G08B 5/36; G06F 11/3093; G06F 13/4221; G06F 21/86
See application file for complete search history.

(56) References Cited

U.S. PATENT DOCUMENTS 4,906,978 A * 3/1990 Best ..... G08B 17/107 250/574
5,030,009 A * 7/1991 Ando ..... G01N 21/643 356/417
5,339,072 A * 8/1994 Agata ..... G08B 17/113 340/438
5,363,976 A * 11/1994 Kapka ..... G08B 17/113 220/3.8
5,793,295 A * 8/1998 Goldstein ..... G08B 17/113 340/632
6,543,735 B1 * 4/2003 Haynes ..... G08B 17/10 248/300
6,940,410 B2 * 9/2005 Deacy ..... G08B 13/19 340/506
7,994,928 B2 * 8/2011 Richmond ..... G08B 19/005 340/628
8,589,033 B2 * 11/2013 Rafii ..... G06T 7/254 701/49
9,055,664 B1 * 6/2015 Huff ..... H02G 3/281
2002/0097162 A1 * 7/2002 Chambers ..... G08B 17/10 340/628
2004/0032335 A1 * 2/2004 Parrish ..... G08B 29/145 340/628

(Continued)

*Primary Examiner* — Hoi C Lau

(57) ABSTRACT

A smoking detection device with tamper countermeasures is disclosed. A smoking detection circuit includes a smoke and gas sensor is configured to detect a smoking event within an enclosed space of a property, such as a vehicle or a hotel room. Tamper countermeasures prevent a renter from interfering with the detection function of the smoking detection device. The device also includes an event recording element that provides an evidentiary backup in the event of a power failure of the smoking detection device. The event recording element includes a light emitter that is triggered by one or more of smoking detection event and a tamper event. The light emitter exposes a patch of photo sensitive material, that once exposed provides for a visual means of identifying a smoking event or a tamper event during a rental period.

11 Claims, 4 Drawing Sheets

(56) References Cited

U.S. PATENT DOCUMENTS

| | | | | |
|---|---|---|---|---|
| 2005/0083205 | A1* | 4/2005 | Deacy | G08B 17/113 340/628 |
| 2008/0018485 | A1* | 1/2008 | Kadwell | G08B 17/113 340/630 |
| 2010/0052576 | A1* | 3/2010 | Steiner | H05B 47/13 315/361 |
| 2010/0200664 | A1* | 8/2010 | Drew | G01N 33/004 236/94 |
| 2011/0084844 | A1* | 4/2011 | Carnation | G08B 21/14 340/628 |
| 2012/0050030 | A1* | 3/2012 | Murphy | G08B 17/113 340/514 |
| 2012/0062372 | A1* | 3/2012 | Augst | G06K 9/00798 340/435 |
| 2012/0105193 | A1* | 5/2012 | Gritti | G08B 13/19695 340/3.4 |
| 2013/0049951 | A1* | 2/2013 | Kalivas | G08B 17/10 340/538 |
| 2014/0266776 | A1* | 9/2014 | Miller | A61B 5/6849 340/870.01 |
| 2015/0228171 | A1* | 8/2015 | Aebersold | G08B 17/107 340/630 |
| 2015/0279134 | A1* | 10/2015 | Warren | G07C 9/23 340/5.85 |
| 2016/0117873 | A1* | 4/2016 | Bevan | G06F 21/32 340/5.2 |
| 2018/0059080 | A1* | 3/2018 | Jun | G01N 33/0013 |
| 2018/0120276 | A1* | 5/2018 | Kane | G01N 21/783 |
| 2018/0184499 | A1* | 6/2018 | Wu | G01J 1/4228 |
| 2020/0150264 | A1* | 5/2020 | Barson | G08B 13/08 |

* cited by examiner

SMOKING DETECTION DEVICE WITH TAMPER COUNTERMEASURES

BACKGROUND OF THE INVENTION

The present invention relates to smoke detection devices, and more particularly to tamper resistant smoke detection devices.

In the hospitality and vehicle rental industries, vendors often have restrictions that preclude their patrons from smoking in designated non-smoking rooms and vehicles. Likewise, these vendors may impose penalties in the form of a cleaning charge for suspected violations of the no smoking terms of service.

The vendor's imposition of these penalties often results in the patron challenging the decision. Typically, the patron's challenge claims that the room or vehicle had not been cleaned thoroughly enough after a previous patron's violation of the vendor's no-smoking policies. In most cases the vendor's detection efforts are relegated to the olfactory senses and diligence of either housekeeping or vehicle recovery personnel. However, the human nose is unreliable and subject to individual perception. Likewise, the results from the human nose are not consistent nor yield standard results across the board in relation to holding a patron accountable for smoking in a smoke free area. Similarly, the human nose is unable to detect smoke if a device is used to mask or eliminate the smoke scent or if chemicals are used to deodorize the smoke particles. Due to these problems, the vendor will often withdraw the penalty in the hopes of retaining the good will of the patron but must still incur the cost of performing a thorough cleaning of the property.

While some traditional smoke detectors can detect smoke, but they fail to detect if the device is obstructed by an object to prevent smoke from being detected.

In instances where the vendor has installed smoking detection device, the device may lack the sophistication to resist tampering by the patron to avoid detection of their indulgence in their smoking habits.

As can be seen, there is a need for an improved smoking detection apparatus with tamper countermeasures.

SUMMARY OF THE INVENTION

In one aspect of the present invention, smoking detection device is disclosed. The smoking device includes a housing. A smoking event detection circuit is contained within the housing. The smoking event detection circuit includes a smoke and a gas sensor configured to activate on a detection of a smoking event. A tamper detection circuit is also contained within the housing. The tamper detection circuit is configured to detect a presence of a proximity tampering event by a covering object placed in a close proximity to the smoke detection device. An event recorder element configured to provide a visual indication of one or more of the smoking event and a proximity tampering event detected by the smoking event detection circuit and the tamper detection circuit.

In some embodiments, a battery source is provided to power each of the smoking event detection circuit and the tamper detection circuit.

In other embodiments, a battery source is provided to power the smoking event detection circuit and an independent battery source is provided to power the tamper detection circuit.

In some embodiments, the event recorder includes a smoking event emitter coupled with the smoking event detection circuit. The smoking event emitter is configured to illuminate upon the detection of the smoking event by the smoking event detection circuit. A first photo sensitive material is positioned to be exposed responsive to an illumination of the smoking event emitter. Each of the smoking event emitter and the first photo sensitive material are contained within the housing.

In other embodiments, a tamper event emitter is coupled with the tamper detection circuit. The tamper event emitter is configured to illuminate upon the proximity tampering event. A second photo sensitive material is positioned to be exposed responsive to the illumination of the tamper event emitter. Each of the tamper event emitter and the second photo sensitive material contained within the housing.

In some embodiments, a cover plate is removably coupled to the housing. When coupled to the housing, the cover plate prevents an external illumination source from exposing each of the first photo sensitive material and the second photo sensitive material. When the cover plate is removed from the housing, each of the first photo sensitive material and the second photo sensitive material may be visually inspected for an exposed condition. When the cover plate is removed from the housing, each of the first photo sensitive material and the second photo sensitive material may be replaced with an unexposed photo sensitive material.

In some embodiments, an infrared proximity sensor is coupled to the tamper detection circuit contained. The infrared proximity sensor is adjustable to a desired triggering proximity of the covering object to the smoking detection device. The desired triggering proximity is about 2 cm.

In other embodiments, a first LED indicator signals a powered-on condition of the tamper detection circuit. A second LED indicator signals the detection of the proximity tampering event.

These and other features, aspects and advantages of the present invention will become better understood with reference to the following drawings, description and claims.

DETAILED DESCRIPTION

Figure 1:
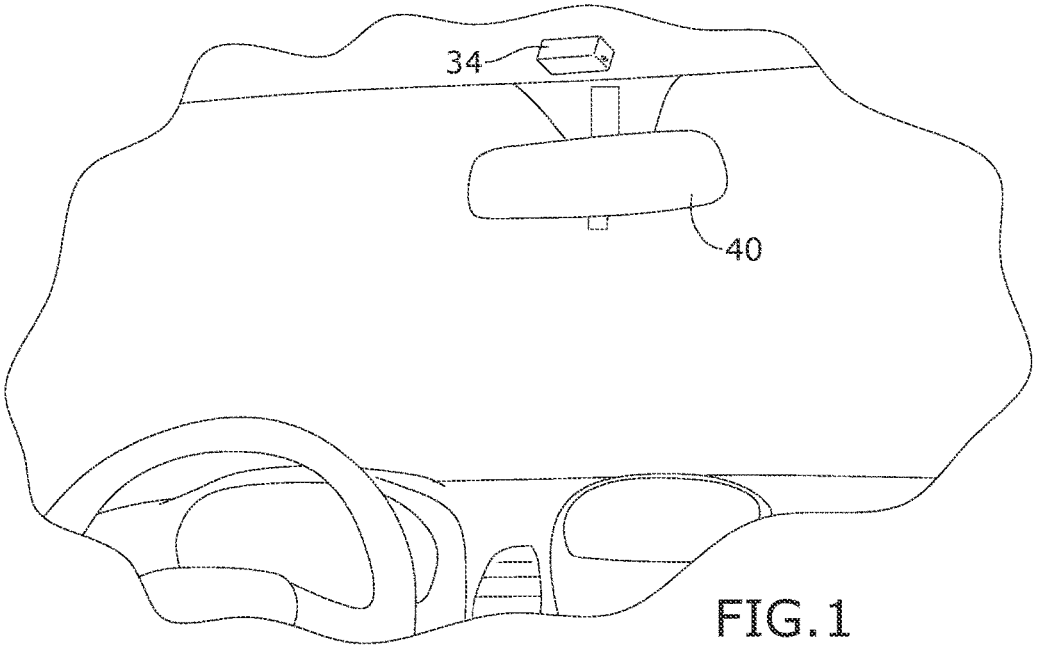
FIG. 1 is a perspective view of a smoking detection device with tamper countermeasures, shown in an exemplary installation.
Figure 2:
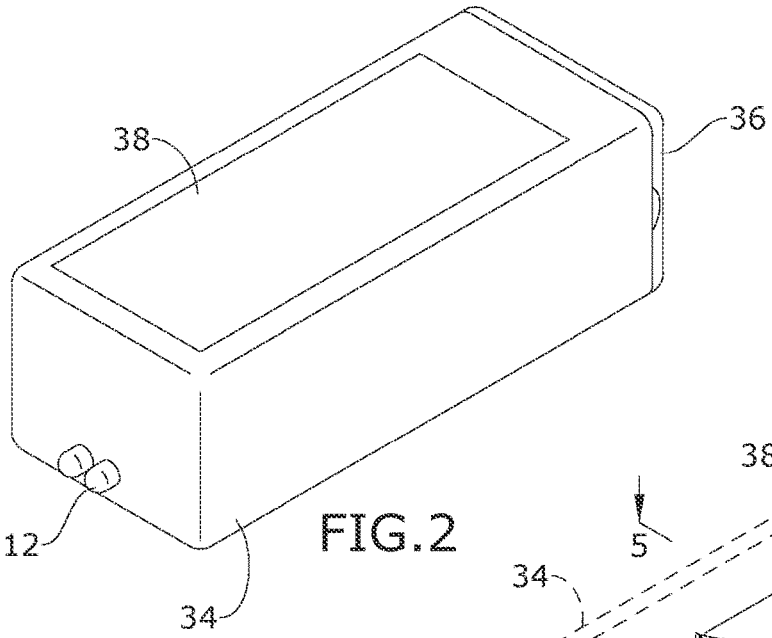
FIG. 2 is a perspective view of the smoking detection device with tamper countermeasures.
Figure 3:
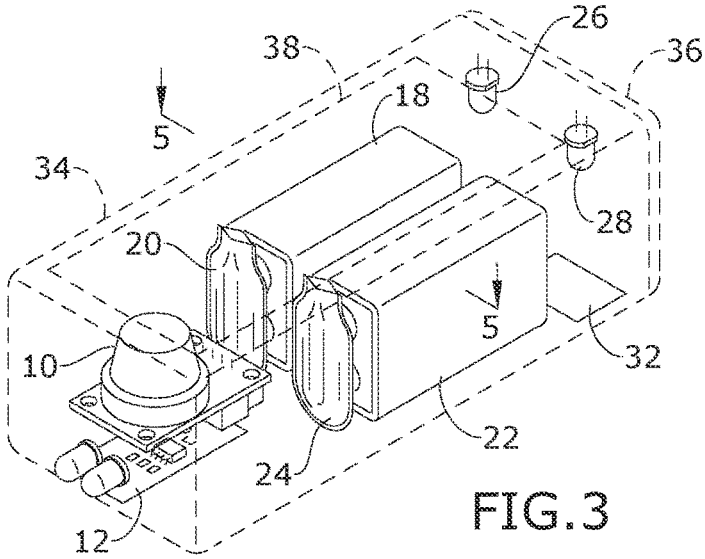
FIG. 3 is a perspective view of the invention, with case 34 shown as hidden to clarify internal components, with wiring not shown for clarity.
Figure 4:
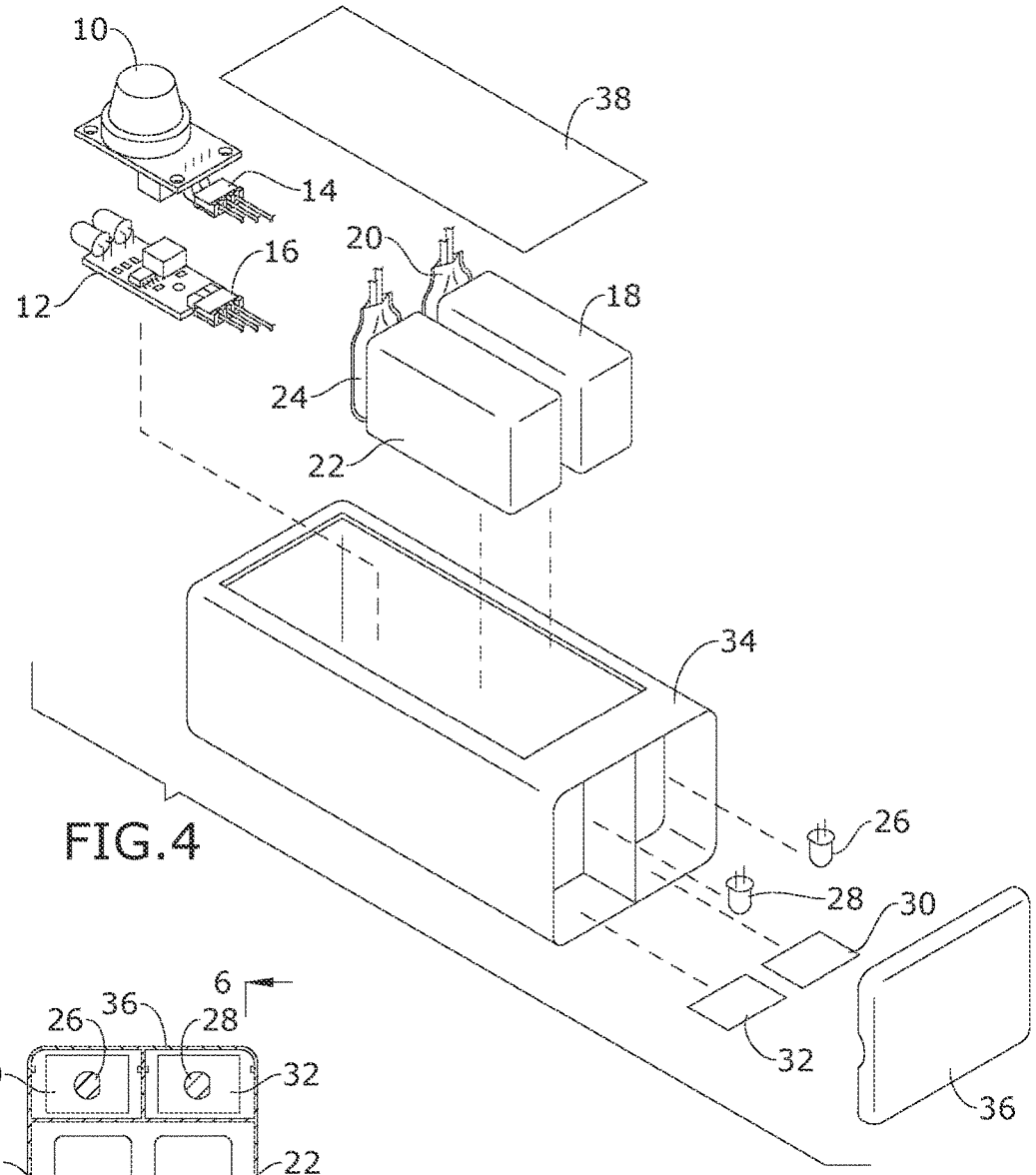
FIG. 4 is an exploded view of the smoking detection device with tamper countermeasures, with wiring truncated for clarity.
Figure 5:
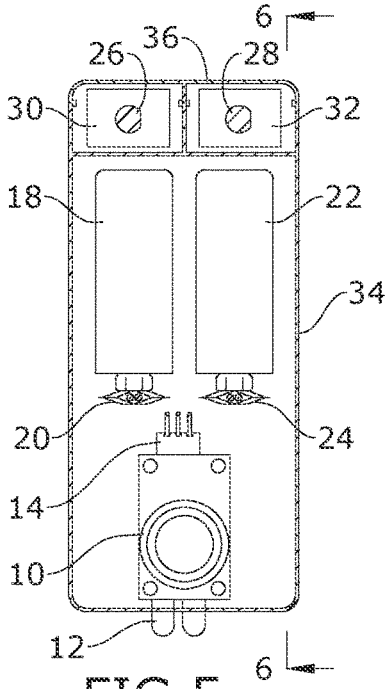
FIG. 5 is a section view of the smoking detection device with tamper countermeasures, taken along line 5-5 in FIG. 3.
Figure 6:
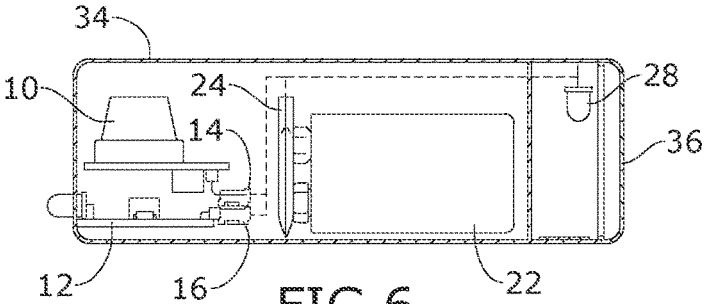
FIG. 6 is a section view of the smoking detection device with tamper countermeasures, taken along line 6-6 in FIG. 5, with wiring show schematically for clarity

The following detailed description is of the best currently contemplated modes of carrying out exemplary embodiments of the invention. The description is not to be taken in a limiting sense but is made merely for the purpose of illustrating the general principles of the invention.

Broadly, embodiments of the present invention provide a smoking detection device with tamper countermeasures. The device may be used in the hospitality and rental industries to detect a smoking event in a non-smoking designated room or vehicle. Tamper countermeasures are provided to prevent a smoker or other user from interfering with the smoke detection capabilities of the device.

The present invention detects smoke in cars regardless whether a deodorizer is used, chemicals are sprayed, the windows are rolled down, vents are closed or if the deforest is turned on. It also detects if a renter attempts to cover the device to prevent smoke from being detected. This device ensures cars or lodgings will be properly cleaned if exposed to smoke. This invention prevents a patron from denying the car has been exposed to smoke and prevents the patron from obstructing the device to prevent the detection of smoke. The device of capable of identify the detection of smoke minutes to months after the location has been exposed to smoke.

Non-limiting embodiments of the present invention is shown in reference to the drawings of FIGS. 1-8. While a vehicle installation is referenced in the drawings, the invention may be employed in any location where smoking restrictions are in place, and the owner of the location desires a reliable detection of a smoking event.

The smoking detection device of the present invention includes a housing 34 containing a smoke detection circuitry and one or more tamper countermeasures. The smoking detection device is configured to detect and alert the owner of the property to the occurrence of a smoking event. The one or more tamper countermeasures prevent the covering of the smoking detection circuitry by reporting on the attempted covering of the smoking detector to prevent detection of the smoking event. An in-vehicle placement of the smoking detection device may include placement on one of the headliner or the windshield interior, for example above a rearview mirror 40 on the interior of the vehicle.

The smoke detection circuitry includes a smoke and a gas sensor 10 carried within the housing. The smoke and gas sensor 10 may be an MQ-6 smoke and gas sensor, used to detect smoke and combustible gases, a detector type: MQ-6 gas sensor, dual signal output (analog (AO pin) and TTL (DO pin) level output), TTL output signal is normally low, goes high when smoke is detected. A gas detection threshold is adjusted with an onboard potentiometer. The smoke and gas sensor 10 has a 0-5V analog output voltage, where the higher the concentration of the detection, the higher the voltage output. The smoke and gas sensor 10 is capable of detection of a gas, a smoke combustion product gas, and fumes. Accordingly, the smoke detection circuitry may detect a smoking event. The smoke detection circuitry may also detect the presence of gasses used as a propellant for an odor masking spray that may be utilized in an attempt to conceal a smoking event.

A tamper detection circuit has an Infrared (IR) sensor module 12, which may include one or more of an obstacle avoidance sensor, an infrared transmitter, an IR receiving tube, and a photoelectric reflection sensor. The IR sensor 12 is configured with a detection distance of between about 2-30 cm and a detection angle of about 35 degrees. The tamper detection circuit may also include comparators, such as the LM393. The IR sensor module 12 can be powered by a 3-5V DC power supply. When the power is turned on, a power indicator LED 26 illuminates. The detection distance can be adjusted by a potentiometer knob. The IR transmitter emits infrared rays of a predetermined frequency. When the IR sensor module 12 detects an obstacle signal to cover the IR sensor module 12, the infrared light is reflected back and received by the IR receiving tube, and passes through the comparator.

After the circuit is processed, an obstruction detected LED indicator 28, which may be green, illuminates and the output continuously outputs a low level signal. The obstruction detected indicator 28 provides the owner with an indication that the device has been obstructed during a rental period. The obstruction detected indicator 28 remains illuminated until reset by the owner of the device.

The smoke and gas sensor 10 is connected to a power source 28, such as a battery via an electrical connector 14. The IR sensor module is connected to an independent power source 22. Each of the power source 28 and the independent power source 22 may be a battery.

Each of the smoke detection circuit and the tamper detection circuit may also include a recorder element to provide the owner a record of at least one of a smoking detection event and a tampering event. The recorder element includes a smoking event detected emitter 26 and a patch of photo sensitive material 30. The recorder element may also include a tamper event emitter 28 and a corresponding patch of photo sensitive material 32. A baffle separates the smoking event emitter 26 and its associated photo sensitive material 30 from the tamper detection emitter 28 and its associated photo sensitive material 32. Each are carried within the housing 34 with the patches of photo sensitive material accessible by a removable cover plate 36.

In the non-limiting embodiment shown, the recorder element includes an additional ultraviolet (UV) emitter 26, 28, such as a UV LED operatively connected with each of the smoke detection circuit and tamper detection circuit. The UV LEDs 26, 28 are configured to emit a UV light upon detection of a smoking event or a tamper event. The UV LEDs 26, 28 are oriented to project onto a patch of a UV light sensitive material 30, 32 carried within the housing 34. The UV light sensitive material 30, 32 may be a replaceable patch of UV sensitive paper that becomes exposed upon illumination of the UV LEDs 26,28. The recorder element provides the owner a record of one or more of the smoking event and the tamper event that may be conveniently checked by the housekeeping or vehicle return agent by a visual inspection of the photo sensitive material 30, 32.

Figure 7:
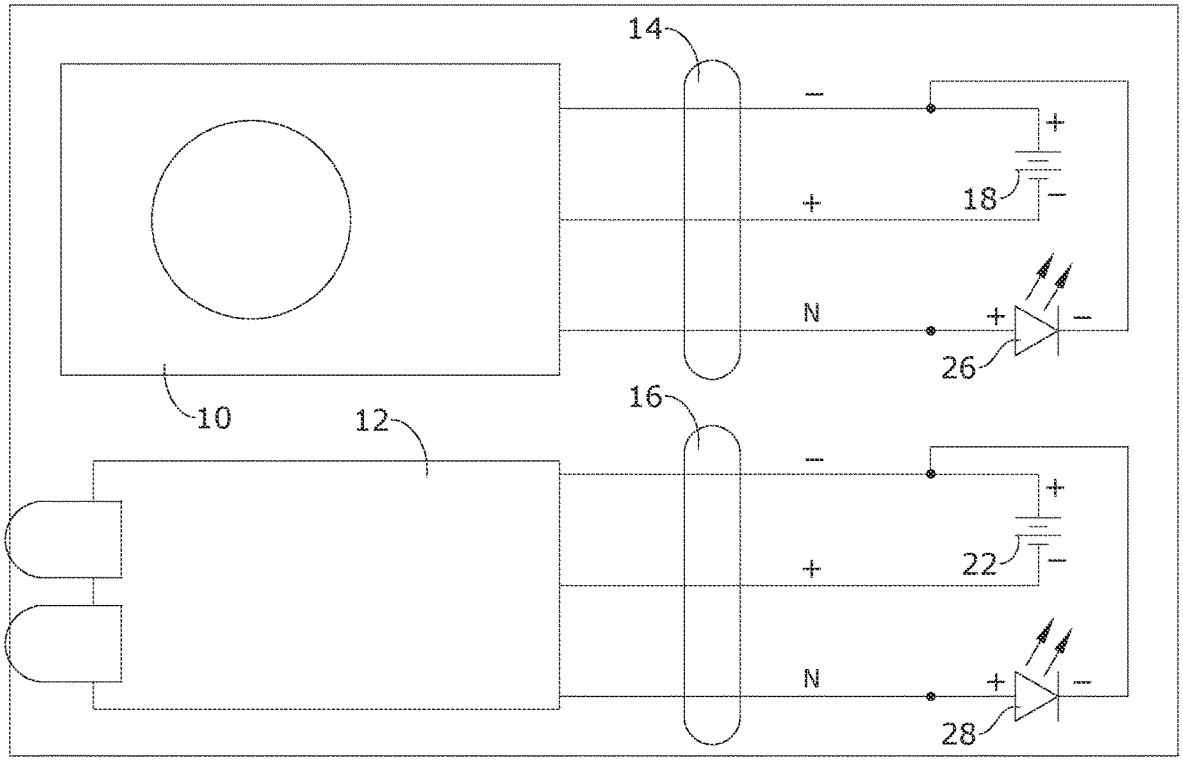
FIG. 7 is a schematic wiring diagram of the smoking detection device with tamper countermeasures.

A representative circuit is shown in reference to FIG. 7. A positive lead of the battery adapter is connected to a negative lead (−) of the smoke and gas sensor 10. The negative lead of the battery adapter is connected to a positive lead of the smoke and gas sensor 10 12. The neutral wire of the smoke and gas sensor 10 12 is connected to an anode (+) positive side of the UV LED emitter 26 with a negative side of the emitter 28 connected with the positive lead of the battery connector. A nine volt battery 22 may be connected to the battery adapter as a power source for the tamper detection circuit.

The tamper sensor 12 is attached to the battery 22 with leads extending from the connector 16 to a battery adapter. A positive lead of the battery adapter is connected to a negative lead (−) of the tamper sensor 12. The negative lead of the battery adapter is connected to a positive lead of the tamper sensor 12. The neutral wire of the tamper sensor 12 is connected to an anode (+) positive side of the UV LED emitter 28 with a negative side of the emitter 28 connected with the positive lead of the battery connector. A nine volt battery 22 may be connected to the battery adapter as a power source for the tamper detection circuit.

Figure 8:
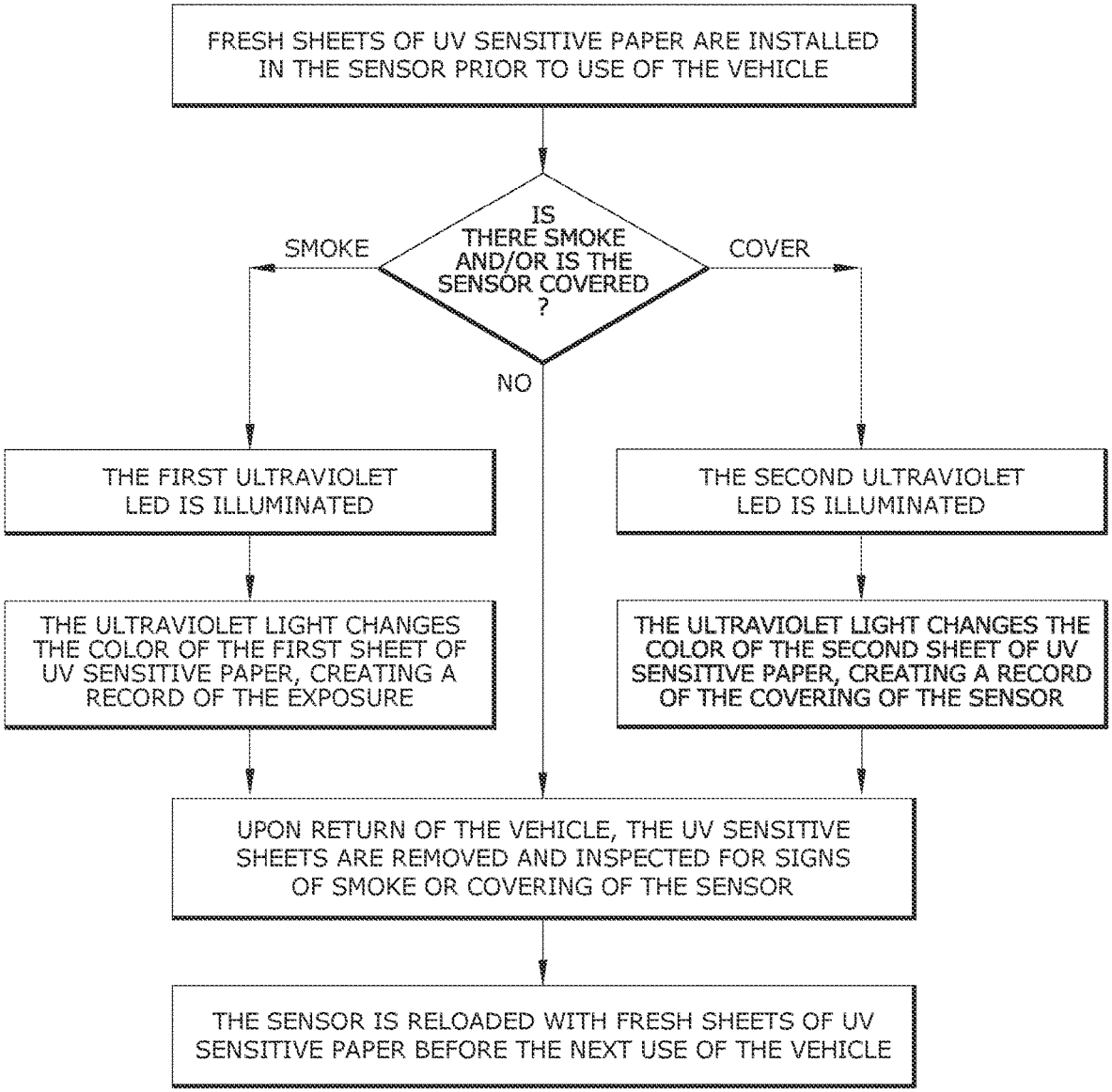
FIG. 8 is a flow chart of the smoking detection device with tamper countermeasures.

A method of detecting a smoking event or a tampering event is shown in reference to FIG. 8. The photo sensitive material 30, 32 may be placed in the isolated compartments within the housing 34. The smoke and gas detector is attached within the vehicle proximal to the rear view mirror 40. In a smoking event detection path, during a smoking event, smoke fills the air within the enclosed space of the vehicle. The smoke and gas detector 10 detects smoke. Once the smoke and gas detector 10 detects smoke the smoking event light emitter 26 is activated. The activated smoking event light emitter 26 exposes the patch of photo sensitive material 30.

In a tamper detection path, the tamper detection circuit detects a tampering event, such as when the smoking detection device with tamper countermeasures is covered with an object in an attempt to prevent the smoke from being detected. If the object is positioned within 2-30 cm of the IR sensor module 12, triggering a tamper event. The IR sensor module 12 is activated, which activates the tamper event emitter 28. Activation of the tamper event emitter 28 exposes the patch of photo sensitive material 32, providing a record of the tamper event. Both the smoking detection path and the tamper detection path can work simultaneously and/or independently of one another.

When the vehicle is returned the car company, a vehicle return agent can inspects the vehicle, as usual. The vehicle return agent also removes the cover plate 36 to inspect the photo sensitive patches 30, 32 for an exposed condition indicating the happening of one or more of a smoking event or a tampering event. If the photo sensitive patches 30, 32 have not changed in color from their original state, this indicates that neither a smoking event or a tampering event was detected. If the photo sensitive patches 30, 32 has changed color from its original state this indicate that the device was exposed to a smoking event and/or a tamper event. In this instance the user may be charged a vehicle cleaning fee. To return the smoking detection device with tamper countermeasures and the vehicle to service. replacement photo sensitive patches 30, 32 is are installed in the device and the vehicle is returned to service.

In some embodiments, the smoking detection device with tamper countermeasures device can be configured with a communications module. In this case, rather than illuminating the smoking event emitter 26 or the tamper event emitter 28, the communications module can communicate the detected event to a server, coupled to a computer data base indicating the detection of a prohibited action.

As will be appreciated the smoking detection device with tamper countermeasures can be used in hotels and other areas with smoking prohibitions to detect smoke and identify if the device has been covered to prevent the detection of smoke. This invention can be used in company vehicles. Parents can also use this invention for their teen drivers and or kids who are away to school. This invention can also be installed in cars and transmit the information such as, the detection of smoke and objects covering the device via a computer system.

It should be understood, of course, that the foregoing relates to exemplary embodiments of the invention and that modifications may be made without departing from the spirit and scope of the invention as set forth in the following claims.

What is claimed is:

1. A smoking detection device, comprising:

a housing;

a smoking event detection circuit contained within the housing, the smoking event detection circuit including a smoke and a gas sensor configured to activate on a detection of a smoking event;

a tamper detection circuit contained with the housing, the tamper detection circuit configured to detect a presence of a proximity tampering event by a covering object placed in a close proximity to the smoke detection device; and an event recorder element comprising a patch of a photosensitive material that is configured to be exposed responsive to an activation of the smoking event detection circuit or the tamper detection circuit to provide a tangible record of one or more of the smoking event and a proximity tamper event detected by the smoking event detection circuit and the tamper detection circuit.

2. The smoking detection device of claim 1, further comprising:

a battery source to power each of the smoking event detection circuit and the tamper detection circuit.

3. The smoking detection device or claim 1, further comprising:

a battery source to power the smoking event detection circuit; and an independent battery source to power the tamper detection circuit.

4. The smoking detection device of claim 1, event recorder further comprises:

a smoking event emitter coupled with the smoking event detection circuit, the smoking event emitter configured to illuminate upon the detection of the smoking event by the smoking event detection circuit;

the patch of a photosensitive material further comprising a first photo sensitive material positioned to be exposed responsive to an illumination of the smoking event emitter; and each of the smoking event emitter and the first photo sensitive material contained within the housing.

5. The smoking detection device of claim 4, further comprising:

a tamper event emitter coupled with the tamper detection circuit, the tamper event emitter configured to illuminate upon the proximity tampering event;

the patch of a photosensitive material further comprising a second photo sensitive material positioned to be exposed responsive to the illumination of the tamper event emitter; and each of the tamper event emitter and the second photo sensitive material contained within the housing.

6. The smoking detection device of claim 5, further comprising:

a cover plate removably coupled to the housing, wherein when coupled to the housing the cover plate prevents an external illumination source from exposing each of the first photo sensitive material and the second photo sensitive material.

7. The smoking detection device of claim 6, wherein when the cover plate is removed from the housing, each of the first photo sensitive material and the second photo sensitive material is visually inspectable for an exposed condition.

8. The smoking detection device of claim 7, wherein when the cover plate is removed from the housing, each of the first photo sensitive material and the second photo sensitive material is replaceable with an unexposed photo sensitive material.

9. The smoking detection device of claim 1, further comprising:

an infrared proximity sensor coupled to the tamper detection circuit contained, the infrared proximity sensor adjustable to a desired triggering proximity of the covering object to the smoking detection device.

10. The smoking detection device of claim 9, wherein the desired triggering proximity is about 2 cm.

11. The smoking detection device of claim 10, further comprising;

a first LED indicator signaling a powered-on condition of the tamper detection circuit; and a second LED indicator signaling the detection of the proximity tampering event.

* * * * *